US011976434B2

(12) United States Patent
Edgerton et al.

(10) Patent No.: US 11,976,434 B2
(45) Date of Patent: May 7, 2024

(54) LAND ANCHOR DEVICE

(71) Applicants: Larry Edgerton, Flint, TX (US); Clara Hogue, Flint, TX (US)

(72) Inventors: Larry Edgerton, Flint, TX (US); Clara Hogue, Flint, TX (US)

( * ) Notice: Subject to any disclaimer, the term of this patent is extended or adjusted under 35 U.S.C. 154(b) by 227 days.

(21) Appl. No.: 17/678,801

(22) Filed: Feb. 23, 2022

(65) Prior Publication Data

US 2023/0265629 A1 Aug. 24, 2023

(51) Int. Cl.
*E02D 5/80* (2006.01)
*E04H 12/22* (2006.01)
*E04H 15/62* (2006.01)

(52) U.S. Cl.
CPC ..... *E02D 5/803* (2013.01); *E02D 5/80* (2013.01); *E02D 5/801* (2013.01); *E04H 12/2215* (2013.01); *E04H 15/62* (2013.01)

(58) Field of Classification Search
CPC ..... E02D 5/80; E02D 5/801; E02D 5/803; E04H 12/2215; E04H 12/2223; E04H 15/62
See application file for complete search history.

(56) References Cited

U.S. PATENT DOCUMENTS 727,335 A * 5/1903 Fisher ..... E02D 5/803 114/305
958,127 A * 5/1910 Horvud ..... E02D 5/803 411/394
1,015,611 A * 1/1912 Bowen ..... E02D 5/803 52/161
1,167,852 A * 1/1916 Sprague ..... E02D 5/803 52/164
1,726,526 A * 9/1929 Colvin ..... E02D 5/803 52/160
1,907,811 A * 5/1933 Hollos ..... E02D 5/801 52/156
1,955,389 A * 4/1934 Samson ..... E02D 5/803 52/160
2,176,566 A * 10/1939 Dillon ..... E02D 5/803 52/160
2,250,780 A * 7/1941 Stroup ..... E02D 5/803 312/405
3,012,644 A * 12/1961 Bush ..... E02D 5/803 52/162

(Continued)

FOREIGN PATENT DOCUMENTS

CA 2405617 A1 * 12/2003 ..... E02D 5/805
CN 108221977 A * 6/2018

(Continued)

*Primary Examiner* — Jessie T Fonseca

(57) ABSTRACT

A land anchor device for securing a boat to the shore using a pair of deployable plates includes a tube having a top surface. The tube has an interior that defines a space where a variety of elements can be positioned within. The end of a tube is a spear that impales into the ground. A drive is positioned on the top surface of the tube. A lead screw is connected to the driver where the driver rotates the lead screw when in use. A plurality of lead nuts is enwrapped on the lead screw and move along an axis of the lead screw. A pair of arms is coupled to a lead screw and move into a perpendicular position for securing a rope around. A pair of plates is positioned near the spear and helps stabilize the tube within the ground.

15 Claims, 5 Drawing Sheets

(56) References Cited

U.S. PATENT DOCUMENTS 3,017,000 A * 1/1962 Hynds ..... B63B 21/26 52/164
3,063,402 A 11/1962 Vallquist
3,924,371 A * 12/1975 Kidwell ..... E02D 5/803 52/162
3,988,998 A 11/1976 Kendrick
4,160,613 A * 7/1979 Stanwick ..... E02D 27/50 405/259.1
4,178,726 A * 12/1979 Watson ..... E02D 5/803 52/515
4,189,879 A * 2/1980 Patterson ..... E02D 5/803 52/161
4,936,194 A 6/1990 Horowitz
5,010,698 A * 4/1991 Hugron ..... E02D 5/805 135/118
6,256,942 B1 * 7/2001 Schatz ..... E02D 5/803 52/156
D546,167 S 7/2007 Noethe
8,230,648 B2 7/2012 Bulloch
2003/0221378 A1 * 12/2003 Krieger ..... E04H 15/62 52/155
2012/0125247 A1 5/2012 Sheridan
2015/0308065 A1 * 10/2015 Yun ..... E02D 5/803 52/156
2018/0371784 A1 * 12/2018 Gonzalez ..... E04H 12/2246

FOREIGN PATENT DOCUMENTS

CN 109680686 A * 4/2019 ..... E02D 5/80
DE 202012005241 U1 * 1/2013 ..... E02D 5/803
EP 2138638 A1 * 12/2009 ..... E02D 5/54
GB 798426 7/1958
KR 20110003998 U * 4/2011
KR 20110124852 A * 11/2011
KR 101235169 B1 * 9/2012
WO WO-2017137652 A1 * 8/2017

* cited by examiner

LAND ANCHOR DEVICE

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to boat anchoring devices and more particularly pertains to a new boat anchoring device for securing a boat to the shore using a pair of deployable plates.

(2) Description of Related Art Including Information Disclosed Under 37 CFR 1.97 and 1.98

The prior art relates to boat anchoring devices. The prior art includes a variety of boat anchoring devices having a spear end being configured for striking into the ground. Known prior art lacks a boat anchoring device having a spear end with a pair of plates being extendable from the boat anchoring device for securing within the ground.

(h) BRIEF SUMMARY OF THE INVENTION

An embodiment of the disclosure meets the needs presented above by generally comprising a tube. The tube has a top surface and an interior. The interior defines a space where a variety of elements can be positioned within. The tube has an end being configured for impaling into the ground. A driver is positioned in a center of the top surface. The driver is the first portion of a crank mechanism. A lead screw is positioned in a center of the interior of the tube. An end of the lead screw is coupled to the driver. The lead screw is configured for rotation relative to the rotation of the driver. The lead screw has an exterior surface. Each lead nut of a plurality of lead nuts is positioned concentric to the lead screw. Each of the lead nuts has an internal surface and the internal surface is complementary to the exterior surface of the lead screw. A crank is the second portion of the crank mechanism. The crank has an input and the input is configured for being fastened within the driver whereby the user can rotate the drive by the crank. Each plate of a pair of plates is coupled to a scissor mechanism. The scissor mechanism is coupled to a pair of lead nuts of the plurality of lead nuts. The scissor mechanism is configured for extending each of the plates outward from the tube when each of the lead nuts is moved along the lead screw during rotation.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
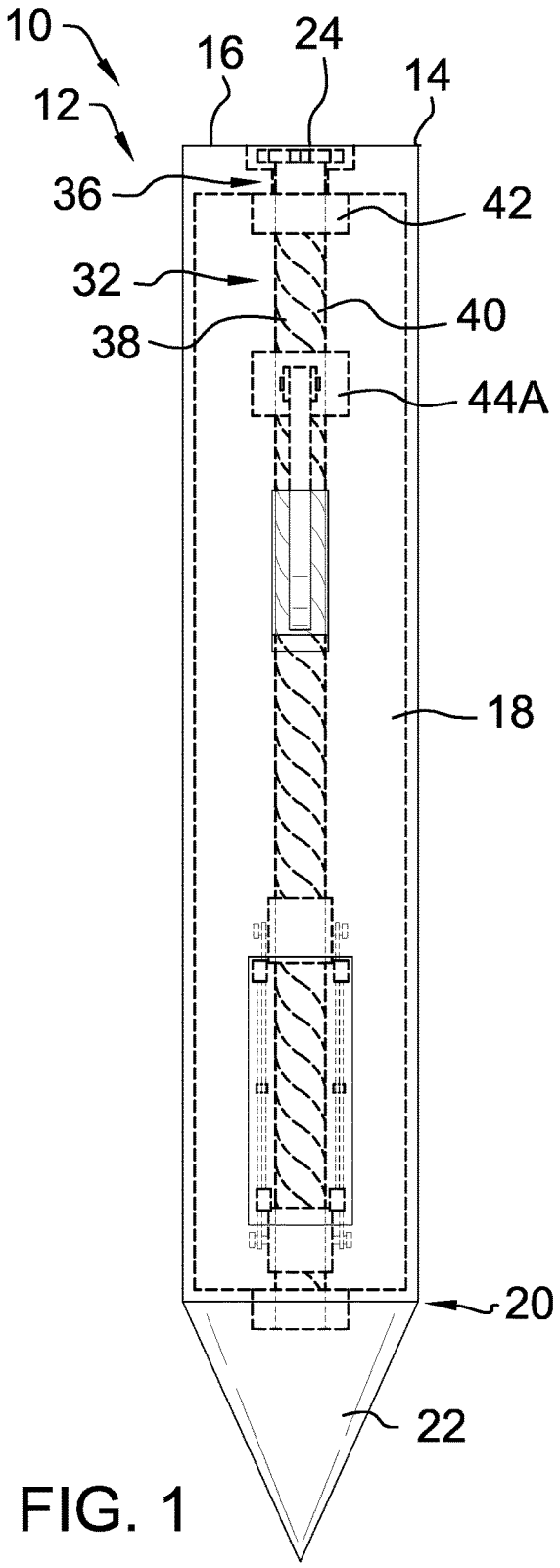
FIG. 1 is a front view of a land anchor device according to an embodiment of the disclosure.
Figure 2:
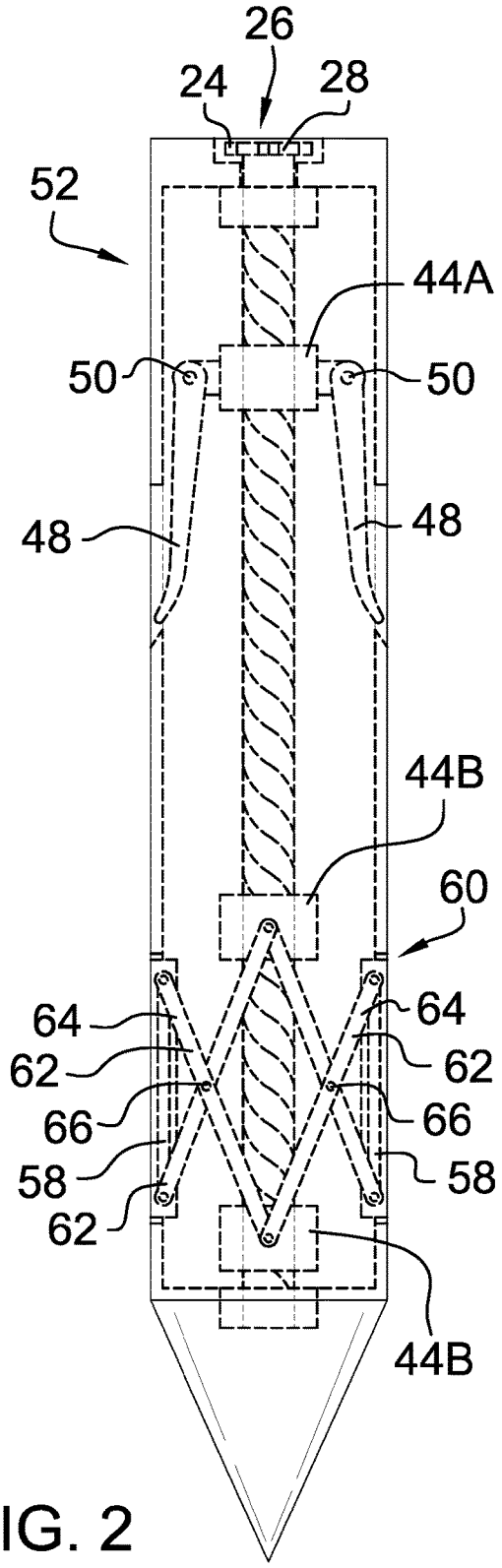
FIG. 2 is a left side view of an embodiment of the disclosure.

With reference now to the drawings, and in particular to FIGS. 1 through 6 thereof, a new boat anchoring device embodying the principles and concepts of an embodiment of the disclosure and generally designated by the reference numeral 10 will be described.

As best illustrated in FIGS. 1 through 6, the land anchor device 10 generally comprises a tube 12. The tube 12 has a cylindrical body 14 and a top surface 16. The top surface 16 is flat. The tube 12 has an interior 18 that defines a space where a variety of elements can be positioned within. The tube 12 has an end 20 whereby the end 20 of the tube 12 is a spear 22. The spear 22 has a triangular cone shape and is configured for impaling into the ground 13.

A driver 24 is positioned in a center 26 of the top surface 16. The driver 24 has a star shape 28 and is recessed into the top surface 16. The driver 24 is a first portion of a crank mechanism 30. The driver 24 is configured for being an element where the user 11 can operate a variety of elements of the land anchor device 10.

A lead screw 32 is positioned in a center 34 of the interior 18 of the tube 12. And end 36 of the lead screw 32 is coupled to the driver 24. The lead screw 32 has an exterior surface 38. The exterior surface 38 has threading 40. The lead screw 32 is configured for rotation relative to rotation of the driver 24 whereby the user 11 rotates the lead screw 32 when rotating with the driver 24. A bearing 42 is positioned proximate to the end 36 of the lead screw 32. The bearing 42 is enwrapped around the exterior surface 38 of the lead screw 32. The bearing 42 is configured for retaining the lead screw 32 from lateral movement within the interior 18 of the tube 12.

Each lead nut 44 of a plurality of lead nuts 44 is positioned concentric to the lead screw 32. Each of the lead nuts 44 has an interior surface 46 and the interior surface 46 has threading 40. The interior surface 46 of each of the lead nuts 44 is enwrapped around the exterior surface 38 of the lead screw 32.

Figure 3:
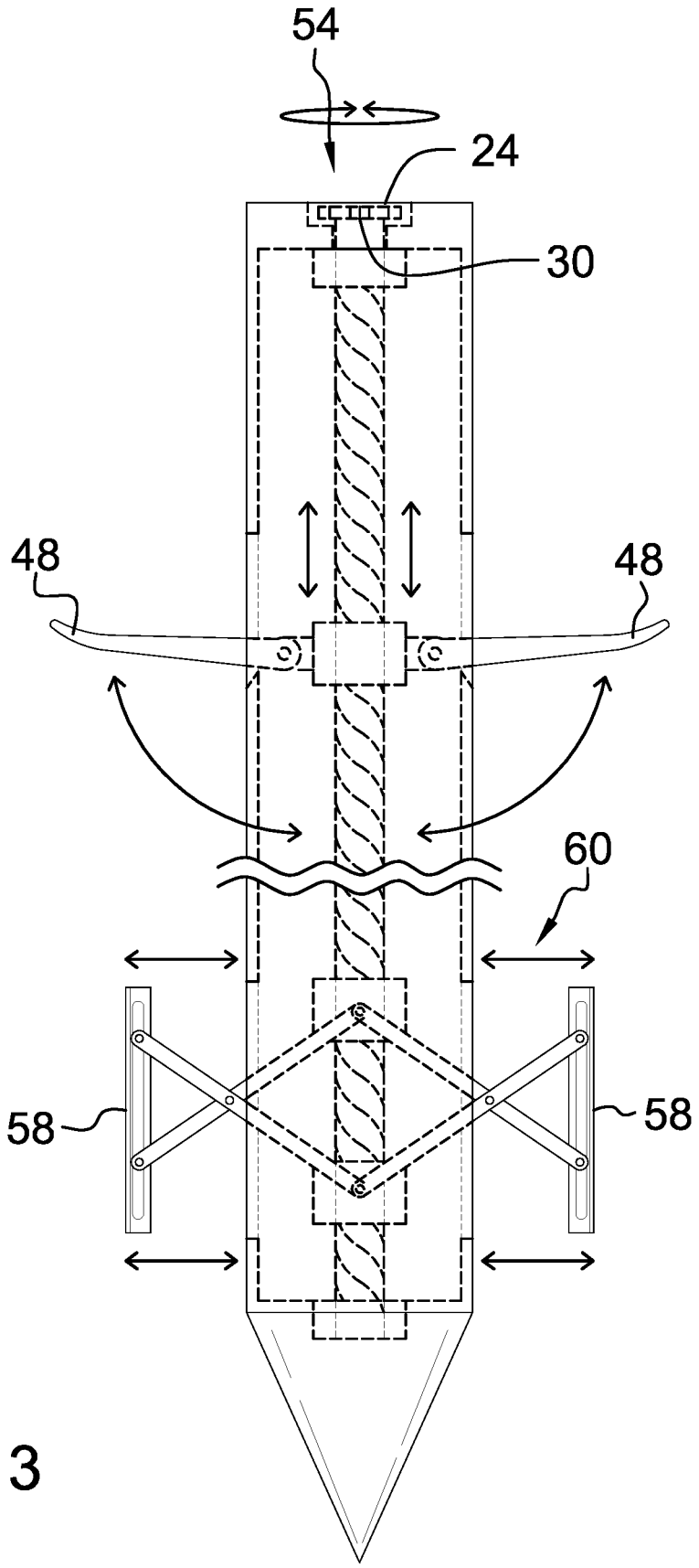
FIG. 3 is a right side view of an embodiment of the disclosure.
Figure 4:
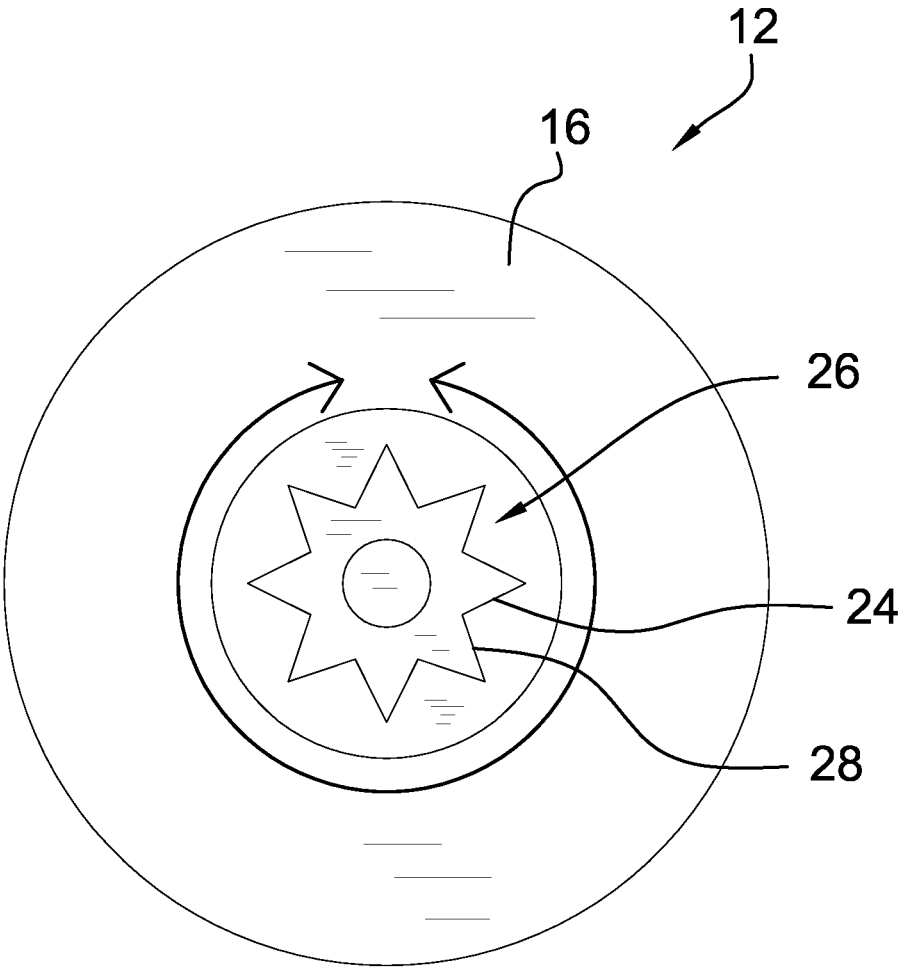
FIG. 4 is a top view of an embodiment of the disclosure.
Figure 5:
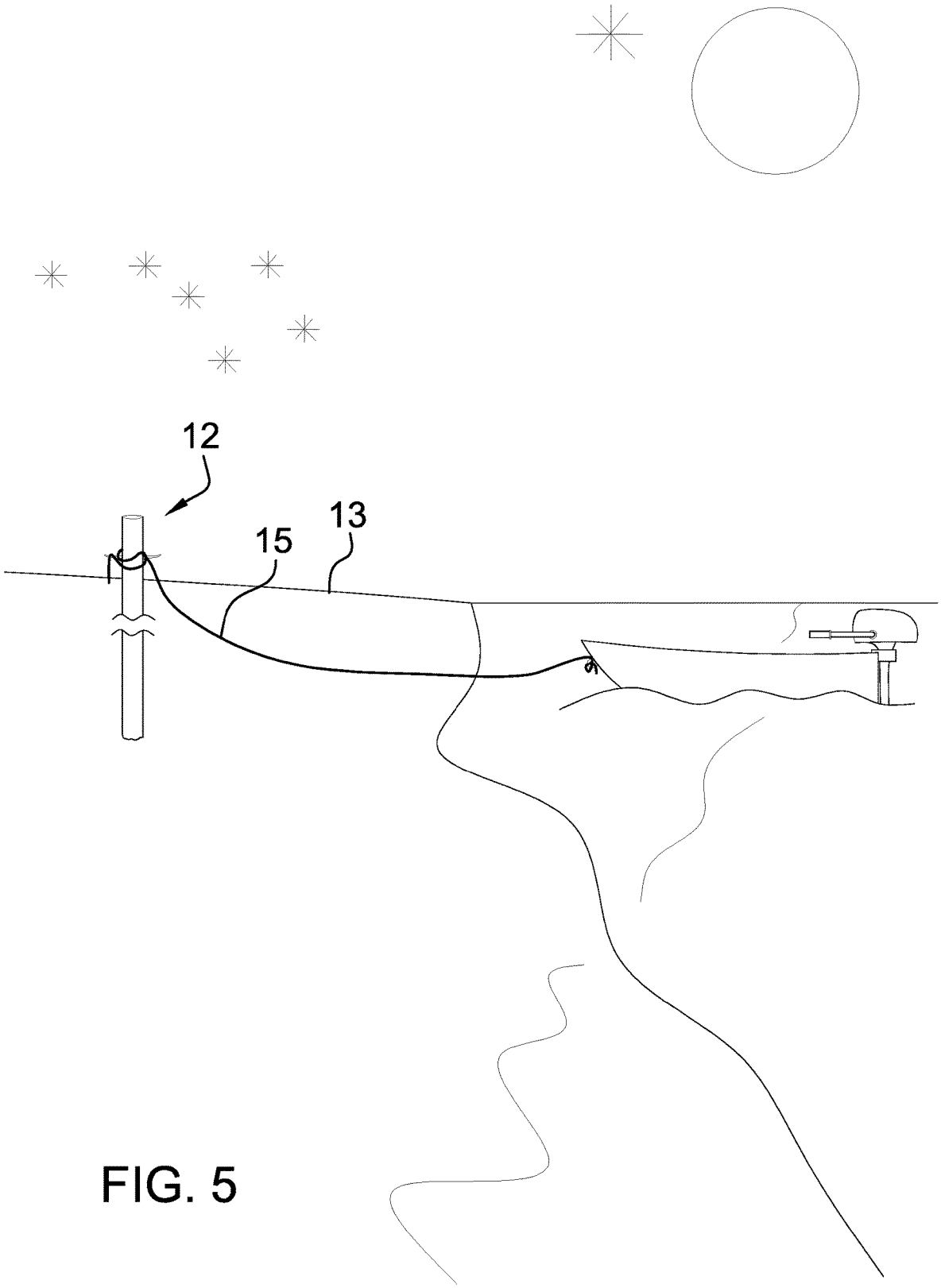
FIG. 5 is an in-use view of an embodiment of the disclosure.
Figure 6:
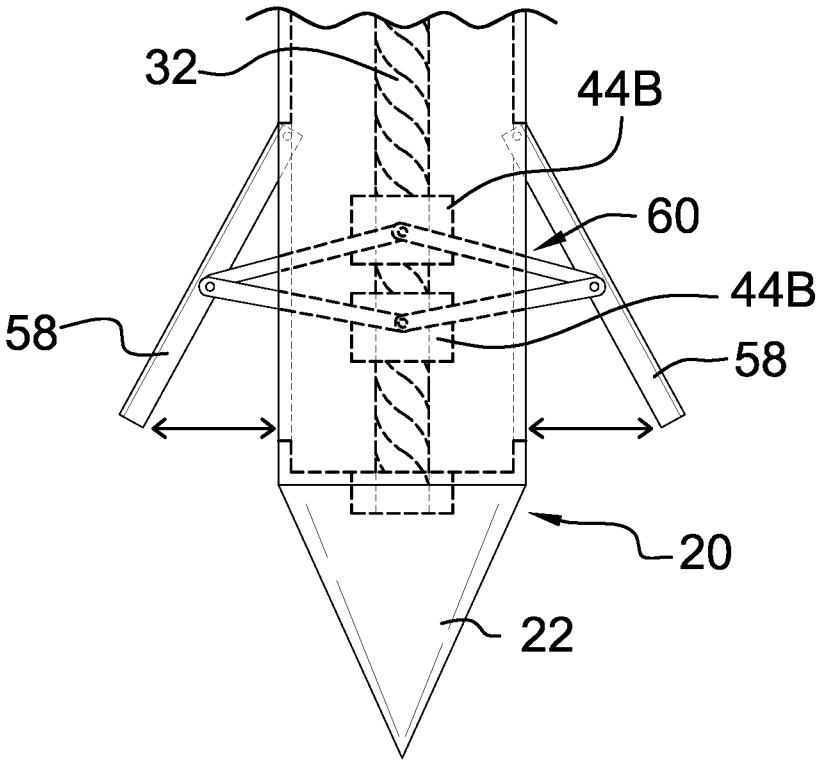
FIG. 6 is an alternative view of an embodiment of the disclosure.

As shown in FIG. 3, the interior surface 46 of each of the lead nuts 44 is complementary to the exterior surface 38 of the lead screw 32 whereby each of the lead nuts 44 engages by threading 40 to the lead screw 32. Each of the lead nuts 44 is configured for movement along the lead screw 32 as the lead screw 32 rotates. A pair of arms 48 is coupled to a lead nut 44A of the plurality of lead nuts 44. Each of the arms 48 has an end 50 whereby the end 50 of each of the arms 48 is coupled to the lead nut 44A. When in a dormant position 52, each of the arms 48 is in a parallel position relative to the tube 12. Furthermore, each of the arms 48 is positioned in the interior 18 of the tube 12.

During rotation of the lead screw 32, the lead nut 44A begins to move away from the end 36 of the lead screw 32. As the lead nut 44A moves, each of the arms 48 begins to extend outward from the tube 12 and form a perpendicular position relative to the tube 12. The pair of arms 48 is configured for the user 11 securing a rope 15 around to retain a boat offshore. A crank 54 is the second portion of the crank mechanism 30. The crank 54 has an input 56. The input 56 is star shaped 28 and is complementary to the driver 24. The input 56 is configured for being fastener within the driver 24 on the top surface 16 of the tube 12. The input 56 is an element for the hand of the user 11 to operate the variety of elements within the interior 18 of the tube 12.

Each plate 58 of a pair of plates 58 is coupled to a scissor mechanism 60. The scissor mechanism 60 comprises a pair of bars 62. Each of the bars 62 is a lever 64 and each of the bars 62 is coupled to each other in a center 66 of each of the bars 62. The scissor mechanism 60 is coupled to a pair of lead nuts 44B of the plurality of lead nuts 44B. Each of the lead nuts 44B is configured for movement in opposite direction of each other when the lead screw 32 is in rotation.

During rotation of the lead screw 32, each of the lead nuts 44B moves towards each other whereby engaging with the scissor mechanism 60 of each of the plates 58 to extend each of the plates 58 outward from the tube 12. In opposite rotation, each of the lead nuts 44B retracts from each other, whereby engaging the scissor mechanism 60 of each of the plates 58 to withdraw each of the plates 58 towards the tube 12.

In use, the user 11 will pierce the ground 13 using the spear 22 on the end 20 of the tube 12. After the tube 12 is lodged within the ground 13, the user 11 positions the input 56 of the crank 54 within the driver 24. The user 11 will rotate the crank 65 whereby rotating the driver 24 which will operate the mechanisms within the tube 12. The lead screw 32 rotates in unison with the driver 24. Each of the lead nuts 44 engages by threading 40 with the lead screw 32 whereby each of the lead nuts 44 moves along the lead screw 32. The lead nut 44A coupled to the pair of arms 48 moves away from the end 36 of the lead screw 32 whereby each of the arms 48 extends outward from the tube 12 into a perpendicular position relative to the tube 12.

Each lead nut 44B of the pair of lead nuts 44B moves towards each other along the lead screw 32 whereby engaging with the scissor mechanism 60 of each of the plates 58. As each of the lead nuts 44B moves, the scissor mechanism 60 extends each of the plates 58 outward from the tube 12. The pair of plates 58 helps retain the tube 12 from both movement in the ground 13 and from being removed from the ground 13. The user 11 secures a rope 15 around the pair of arms 48 of the tube 12. The rope 15 is connected to a boat which is floating proximate to the shore where the tube 12 is positioned. When the user 11 wants to remove the tube 12, the user uses the crank 54 to reverse the rotation of the driver 24, whereby the pair of arms 48 and the pair of plates 58 retract into the tube 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A land anchor device comprising:

a tube, said tube having a top surface, said tube having an interior, said interior defines a space where a variety of elements can be positioned within, said tube having an end, said end being configured for impaling into the ground;

a driver, said driver being positioned in a center of said top surface, said driver being first portion of a crank mechanism;

a lead screw, said lead screw being positioned in a center of said interior of said tube, an end of said lead screw being coupled to said driver, said lead screw having an exterior surface, said lead screw being configured for rotation relative to rotation of said driver;

a plurality of lead nuts, each of said lead nuts being positioned concentric to said lead screw, each of said lead nuts having an internal surface, said internal surface of each of said lead nuts being complementary to said exterior surface of said lead screw;

a pair of arms, each of said arms being coupled to a lead nut of said plurality of lead nuts, each of said arms being configured for orientating from a parallel position to a perpendicular position relative to said tube as said driver being rotated;

an crank, said crank being a second portion of said crank mechanism, said crank having an input, said input being configured for being fastened within said driver whereby the user can rotate said driver by said crank; and a pair of plates, each of said plates being coupled to a scissor mechanism, said scissor mechanism being coupled to a pair of lead nuts of said plurality of lead nuts, said scissor mechanism being configured for extending each of said plates outward from said tube when each of said pair of lead nuts being moved along said lead screw during rotation.

2. The land anchor device of claim 1, further comprising said tube being a cylindrical body.

3. The land anchor device of claim 1, further comprising said top surface being flat.

4. The land anchor device of claim 1, further comprising said end being a spear, said spear having a triangular cone shape.

5. The land anchor device of claim 1, further comprising said driver being star shaped.

6. The land anchor device of claim 1, further comprising said driver being recessed into said top surface.

7. The land anchor device of claim 1, further comprising said exterior surface having threading.

8. The land anchor device of claim 1, further comprising a bearing being positioned proximate to said end of said lead screw, said bearing being configured for retaining said lead screw from lateral movement.

9. The land anchor device of claim 1, further comprising said internal surface having threading.

10. The land anchor device of claim 1, further comprising each of said lead nuts being configured for engaging by threading to said lead screw whereby each of said lead nuts having movement along said lead screw by rotation of said lead screw.

11. The land anchor device of claim 1, further comprising each of said arms being coupled to said lead nut at an end of each of said arm.

12. The land anchor device of claim 5, further comprising said input being star shaped such that said input is complementary to said driver.

13. The land anchor device of claim 1, further comprising said scissor mechanism being a pair of bars, each of said bars being coupled to each other in a center of each of said bars.

14. The land anchor device of claim 1, further comprising each of said lead nuts being configured for moving in opposite directions when said driver being rotated.

15. A land anchor device comprising:

a tube, said tube being a cylindrical body, said tube having a top surface, said top surface being flat, said tube having an interior, said interior defines a space where a variety of elements can be positioned within, said tube having an end, said end being a spear, said spear having a triangular cone shape, said end being configured for impaling into the ground;

a driver, said driver being positioned in a center of said top surface, said driver being star shaped, said driver being first, portion of a crank mechanism, said driver being recessed into said top surface;

a lead screw, said lead screw being positioned in a center of said interior of said tube, an end of said lead screw being coupled to said driver, said lead screw having an exterior surface, said exterior surface having threading, said lead screw being configured for rotation relative to rotation of said driver, a bearing being positioned proximate to said end of said lead screw, said bearing being configured for retaining said lead screw from lateral movement;

a plurality of lead nuts, each of said lead nuts being positioned concentric to said lead screw, each of said lead nuts having an internal surface, said internal surface having threading, said internal surface of each of said lead nuts being complementary to said exterior surface of said lead screw, each of said lead nuts being configured for engaging by threading to said lead screw whereby each of said lead nuts having movement along said lead screw by rotation of said lead screw;

a pair of arms, each of said arms being coupled to a lead nut of said plurality of lead nuts, each of said arms being coupled to said lead nut at an end of each of said arm, each of said arms being configured for orientating from a parallel position to a perpendicular position relative to said tube as said driver being rotated;

an crank, said crank being a second portion of said crank mechanism, said crank having an input, said input being said star shape, said input being complementary to said driver, said input being configured for being fastened within said driver whereby the user can rotate said driver by said crank; and a pair of plates, each of said plates being coupled to a scissor mechanism, said scissor mechanism being a pair of bars, each of said bars being coupled to each other in a center of each of said bars, said scissor mechanism being coupled to a pair of lead nuts of said plurality of lead nuts, each of said pair of lead nuts being configured for moving in opposite directions when said driver being rotated, said scissor mechanism being configured for extending each of said plates outward from said tube when each of said pair of lead nuts being moved along said lead screw during rotation.

* * * * *